US012280320B2

(12) United States Patent
Clark

(10) Patent No.: US 12,280,320 B2
(45) Date of Patent: Apr. 22, 2025

(54) SYSTEMS AND METHODS FOR DEPLOYING AND RESETTING SHOW ELEMENTS

(71) Applicant: Universal City Studios LLC, Universal City, CA (US)

(72) Inventor: Benjamin Robert Clark, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 482 days.

(21) Appl. No.: 17/852,648

(22) Filed: Jun. 29, 2022

(65) Prior Publication Data

US 2023/0398464 A1 Dec. 14, 2023

Related U.S. Application Data

(60) Provisional application No. 63/350,556, filed on Jun. 9, 2022.

(51) Int. Cl.

| | |
|---|---|
| ***A63J 5/02*** | (2006.01) |
| ***A63G 31/02*** | (2006.01) |
| ***A63G 31/16*** | (2006.01) |

(52) U.S. Cl.

CPC ..... *A63J 5/02* (2013.01); *A63G 31/02* (2013.01); *A63G 31/16* (2013.01)

(58) Field of Classification Search

CPC ..... A63J 1/00; A63J 1/02; A63J 5/02; A63J 19/006; A63G 31/00; A63G 31/02

USPC ..... 472/75–84

See application file for complete search history.

(56) References Cited

U.S. PATENT DOCUMENTS

| | | | | |
|---|---|---|---|---|
| 2,603,851 | A * | 7/1952 | Hawkins | A61G 7/1015 254/296 |
| 8,641,540 | B2 | 2/2014 | Feuer et al. | |
| 9,943,769 | B2 | 4/2018 | Comploi | |
| 2012/0149480 | A1 | 6/2012 | Crawford et al. | |
| 2013/0014669 | A1 | 1/2013 | Nemeth et al. | |
| 2017/0095742 | A1 | 4/2017 | Boyle | |
| 2022/0134247 | A1 | 5/2022 | Melo | |
| 2022/0143518 | A1 | 5/2022 | Chatrath et al. | |
| 2022/0184512 | A1* | 6/2022 | Freedman | A63J 1/00 |

OTHER PUBLICATIONS

PCT/US2023/024615 International Search Report and Written Opinion mailed Sep. 18, 2023.

* cited by examiner

*Primary Examiner* — Kien T Nguyen
(74) *Attorney, Agent, or Firm* — Fletcher Yoder, P.C.

(57) ABSTRACT

A show system includes a rotatable beam assembly having a rotatable beam, a first track, a second track, and one or more motors. The show system also includes a first show element coupled to the first track to enable the first show element to translate along the first track and a second show element coupled to the second track to enable the second show element to translate along the second track. The show system further includes a controller communicatively coupled to the rotatable beam assembly and configured to provide control signals to the one or more motors to rotate the rotatable beam to cause the first show element to rotate from a show location to a reset location and to cause the second show element to rotate from the reset location to the show location.

20 Claims, 7 Drawing Sheets

SYSTEMS AND METHODS FOR DEPLOYING AND RESETTING SHOW ELEMENTS

CROSS-REFERENCE TO RELATED APPLICATION

This application claims priority to and the benefit of U.S. Provisional Application No. 63/350,556, entitled "SYSTEMS AND METHODS FOR DEPLOYING AND RESETTING SHOW ELEMENTS," filed Jun. 9, 2022, which is hereby incorporated by reference in its entirety for all purposes.

BACKGROUND

This section is intended to introduce the reader to various aspects of art that may be related to various aspects of the present disclosure. This discussion is believed to be helpful in providing the reader with background information to facilitate a better understanding of the various aspects of the present disclosure. Accordingly, it should be understood that these statements are to be read in this light and not as admissions of prior art.

An amusement park generally includes attractions that provide various experiences for guests of the amusement park. For example, the amusement park may include different attractions, such as a roller coaster, a drop tower, a log flume, and so forth. Certain attractions may include show elements (e.g., animated props) that move within a show space.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In an embodiment, a show system includes a rotatable beam assembly having a rotatable beam, a first track, a second track, and one or more motors. The show system also includes a first show element coupled to the first track to enable the first show element to translate along the first track and a second show element coupled to the second track to enable the second show element to translate along the second track. The show system further includes a controller communicatively coupled to the rotatable beam assembly and configured to provide control signals to the one or more motors, with the first show element in a show location, to drive the first show element to translate along the first track to present a respective motion profile in a scene. The controller is also configured to provide the control signals to the one or more motors to rotate the rotatable beam to cause the first show element to rotate from the show location to a reset location and to cause the second show element to rotate from the reset location to the show location. The controller is further configured to provide the control signals to the one or more motors, with the second show element in the show location, to drive the second show element to translate along the second track to present a respective motion profile in the scene.

In an embodiment, a method of operating a show system includes driving, via one or more motors and with a first show element in a show location, the first show element to translate in a first direction along a first track coupled to a rotatable beam to present a respective motion profile to one or more guests in a first ride vehicle. The method also includes rotating, via the one or more motors, the rotatable beam to cause the first show element to rotate from the show location to a reset location and to cause a second show element to rotate from the reset location to the show location. The method further includes driving, via the one or more motors and with the second show element in the show location, the second show element to translate in the first direction along a second track to present a respective motion profile to one or more additional guests in a second ride vehicle.

In an embodiment, a show system includes a rotatable beam assembly with a rotatable beam, a first track positioned on a first side of the rotatable beam, a second track positioned on a second side of the rotatable beam, and one or more motors configured to drive rotation of the rotatable beam. The show system also includes a first show element coupled to the first track to enable the first show element to translate along the first track and a second show element coupled to the second track to enable the second show element to translate along the second track. The show system further includes a controller configured to provide control signals to one or more motors to rotate the rotatable beam to alternate presentation of the first show element and the second show element within a scene.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
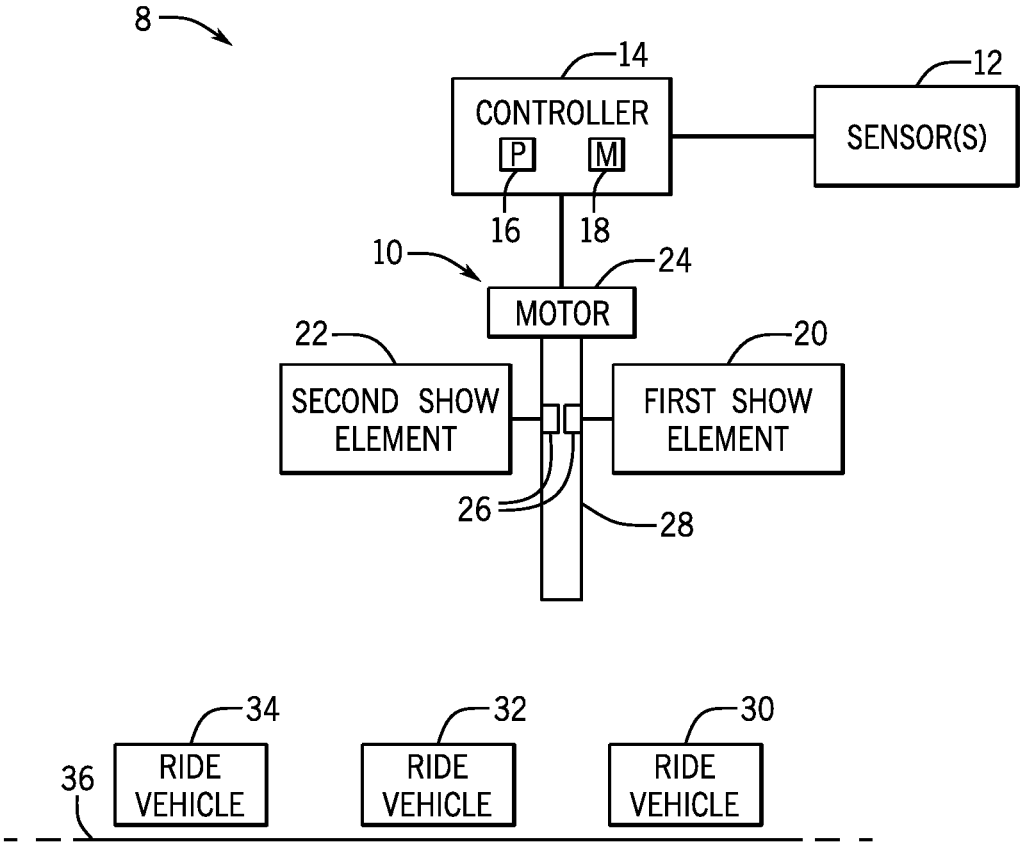
FIG. 1 is a block diagram of an amusement park ride system, in accordance with an embodiment of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

Entertainment systems, such as those typically provided in amusement parks, often employ show elements (e.g., animated props) that move within a show space. It is presently recognized that it may be desirable to improve control of the show elements, such that the show elements move in a manner that enables efficient deployment of animations (e.g., allowing guests traveling in close succession to each view full motion profiles of show elements as the guests travel along a path). The present disclosure relates generally to systems and methods for deploying and resetting show elements. The systems and methods may be implemented within an amusement park, such as within an attraction of the amusement park. However, the systems and methods may be implemented in any suitable venue (e.g., entertainment venue or show venue). It should be appreciated that the show elements may include props (e.g., real, physical elements) that are coupled to show action equipment (SAE). The SAE may include devices and structures that are configured to move the show elements (e.g., within the attraction). For example, the SAE may include beams, tracks, actuators, and the like that drive movement of the show elements to create a show (e.g., visual show) for guests (e.g., visitors, users, customers).

As noted herein, it is presently recognized that it may be desirable to improve movement of the show elements, such that the show elements move in a manner that enables the guests to view full motion profiles of the show elements as the guests travel along a path. This may enable the guests to experience an immersive, engaging storyline as the guests travel along the path. For example, certain ride attractions may carry the guests in ride vehicles along the path. In particular, certain ride attractions may carry the guests in a line of ride vehicles (e.g., one after the other) along the path. Each ride vehicle in the line of ride vehicles may be exposed to a scene (e.g., one or more show elements) along the path for a time period (e.g., show beat; less than or equal to about 60, 30, 20, 10, 9, 8, 7, 6, or 5 seconds). For example, a first ride vehicle in the line of ride vehicles may enter a room along the path, travel through the room along the path, and then exit the room along the path. Then, a second ride vehicle adjacent to the first ride vehicle in the line of ride vehicles may enter the room along the path, travel through the room along the path, and then exit the room along the path. In any case, each ride vehicle (e.g., the first ride vehicle, the second ride vehicle, and so on) may be within the room that includes the show elements and/or otherwise be positioned to view the show elements for the time period. The time period may vary with and/or be based on a speed of travel of each ride vehicle and/or a length of the path through the room (or other space with the show elements).

Advantageously, the systems and methods disclosed herein control the SAE to cause the show elements to complete a motion profile (e.g., show) and reset over the time period. For example, if the time period is seven seconds, then the SAE causes the show elements to complete their motion profiles for the guests in the first ride vehicle and also reset before the guests in the second ride vehicle are exposed to the show elements. Thus, the guests may view the motion profile (e.g., an entirety of the motion profile) from its beginning to its end while they are exposed to the show elements. Due to limiting time constraints on certain attractions (e.g., rides), without the disclosed embodiments, the guests may view only portions of the motion profile and/or view the end prior to the beginning. For example, without the disclosed embodiments, the guests of the first ride vehicle may not have sufficient time to see the end of the motion profile and/or the second ride vehicle may view the end of the motion profile prior to the beginning of the motion profile. Operating the SAE and the show elements so that the guests view the motion profile as disclosed herein enables the guests to be presented with storylines (e.g., that present a story with the show elements completing their respective motion profiles from beginning to end in each scene/room as the guests travel along the path). Further, without introducing delays for the purposes of resetting, present embodiments prevent guests of the ride vehicles from observing a reset phase that is outside of the immersive experience.

In particular, the systems and methods disclosed herein include a controller, a rotatable beam assembly, and show elements (e.g., two show elements, such as two show elements that are duplicates of one another, are identical to one another, and/or are shaped and designed so as to be perceived as essentially the same or duplicates of one another by the guests) coupled to the rotatable beam assembly. The rotatable beam assembly may include a rotatable beam, a first track that supports a first show element of the show elements, and a second track that supports a second show element of the show elements. The first track and the second track are disposed on different sides, such as opposite sides, of the rotatable beam. Further, the rotatable beam assembly may include one or more motors (e.g., electric motors) that drive movement of the first show element along the first track and movement of the second show element along the second track. The one or more motors may also drive rotation of the rotatable beam assembly.

In operation, the controller sends control signals to the one or more motors to drive the first show element along the first track to complete a respective motion profile that is visible to the guests of the first ride vehicle, while also simultaneously resetting the second show element. Then, the controller sends control signals to the one or more motors to drive the second show element along the second track to complete a respective motion profile that is visible to the guests of the second ride vehicle, while also simultaneously resetting the first show element. Thus, the systems and methods effectively halve a run-reset time (e.g., from fourteen seconds to seven seconds) provided for each of the show elements to complete their motion profile and to reset prior to their next motion profile. In turn, the time saved via this efficiency can be shifted for use in providing a more substantial viewing event without taking up valuable ride time. For example, this increased efficiency may allow for an increase in a visible run time for each of the show elements to complete their viewable motion profile in view of the guests, thereby providing an enhanced guest experience. For example, instead of spending several seconds initiating the reset as the first ride vehicle departs the room and/or as the second ride vehicle enters the room, the systems and methods may enable the first show element to begin its motion profile as the first ride vehicle enters the room and end its motion profile as the first ride vehicle departs from the room, and also enable the second show element to begin its motion profile as the second ride vehicle enters the room and end its motion profile as the second ride vehicle departs the room, and so on.

FIG. 1 illustrates a block diagram of an embodiment of an amusement park ride system 8 (e.g., show system). The amusement park ride system 8 includes a rotatable beam assembly 10 (e.g., a show action element [SAE] assembly), one or more sensors 12, and a controller 14 with a processor 16 and a memory device 18. The rotatable beam assembly 10 is coupled to multiple show elements, such as a first show element 20 and a second show element 22. The first show element 20 and the second show element 22 may be props (e.g., real, physical elements), such as animated figures, robots, tools, objects, or the like. The first show element 20 and the second show element 22 may be duplicates of one another (e.g., to provide a show or storyline that is consistent) or different from one another (e.g., to provide different shows or storylines). The rotatable beam assembly 10 includes one or more motors 24 and a rotatable beam 28, wherein the one or more motors 24 drive rotation of the rotatable beam 28. As discussed in more detail herein, the rotatable beam 28 may include or be coupled to tracks (e.g., a first track and a second track on different sides, such as opposite sides, of the rotatable beam 28), and one or more motors 26 are configured to drive the first show element 20 and the second show element 22 move along the tracks (e.g., the first track and the second track, respectively). Examples of the tracks are shown and described with reference to FIGS. 3-7.

Further, the amusement park ride system 8 includes multiple ride vehicles, such as a first ride vehicle 30, a second ride vehicle 32, a third ride vehicle 34, and so on. The multiple ride vehicles may each carry one or more guests, and the multiple ride vehicles travel along a path 36 (e.g., a ride path or track). The path 36 may be a continuous loop and/or may include boarding/unloading station(s). For example, the path 36 may include a boarding station at which the guests board the multiple ride vehicles, a ride portion that includes multiple, distinct scenes (e.g., separate rooms or portions) that present respective show elements to create a storyline, and an unloading station at which the guests exit the multiple ride vehicles.

The multiple ride vehicles may travel along the path 36 according to programmed speed settings and/or with fixed spacing; however, it is possible that the multiple ride vehicles may travel along the path 36 in other ways (e.g., via driving control by the one or more guests in the multiple ride vehicles). The respective guests in each of the multiple ride vehicles may be exposed to a particular scene (e.g., a room; a portion of the path 36) over successive or sequential time periods (e.g., show beats; known time periods; times of less than or equal to about 60, 30, 20, 10, 9, 8, 7, 6, or 5 seconds). For example, the first ride vehicle 30 may be positioned to enable its guests to view the particular scene for the time period, then the second ride vehicle 32 may be positioned to enable its guests to view the particular scene for the time period, then the third ride vehicle 34 may be positioned to enable its guests to view the particular scene for the time period, and so on as the multiple ride vehicles travel along the path 36. Notably, a queue of ride vehicles may be coordinated such that a single ride vehicle may be positioned to enable its guests to view the particular scene over one time period while all of the other ride vehicles are positioned away from the particular scene and/or their guests are unable to view the show elements. In one embodiment, multiple ride vehicles may be positioned to enable their guests to view the particular scene over one time period, but at least one other ride vehicle is positioned away from the particular scene and/or its guests are unable to view the show elements. In any case, the multiple ride vehicles may travel to the multiple, distinct scenes in this way to view the respective show elements in each of the multiple, distinct scenes to follow the storyline during the ride portion. Further, once guests pass the viewing area for the show element in the ride vehicle, in some embodiments, an aspect of the environment (e.g., a tunnel or wall) or a portion of the ride vehicle (e.g., a high-backed seat) may block further viewing of the scene to further enhance immersion in the narrative.

The sensors 12 and the one or more motors 24, 26 are communicatively coupled (e.g., via a wired or a wireless connection) to the controller 14. In one embodiment, the first show element 20 and the second show element 22 may be communicatively coupled (e.g., via a wired or a wireless connection) to the controller 14. In one embodiment, the multiple ride vehicles may be communicatively coupled (e.g., via a wired or a wireless connection) to the controller 14.

In one embodiment, the sensors 12 may be utilized to detect respective positions of the multiple ride vehicles. For example, the sensors 12 may detect each of the multiple ride vehicles upon entry into the particular scene and/or exit from the particular scene (e.g., the particular scene with the show elements 20, 22). The sensors 12 may include motion sensors, position sensors, optical sensors, a camera, and/or any other suitable type of sensor configured to detect the respective positions of the multiple ride vehicles. The sensors 12 may be located along the path 36 (e.g., mounted to a floor or a wall along the path 36) and/or mounted on each of the multiple ride vehicles. The sensors 12 transmit signals indicative of the respective positions of the multiple ride vehicles to the controller 14, and then the controller 14 may initiate other actions based on the signals (e.g., in response to the signals indicating that one of the multiple ride vehicles has entered the scene and/or is within a threshold distance of the show elements 20, 22). It should be appreciated that the sensors 12 may additionally or alternatively be utilized to detect respective characteristics (e.g., positions, gestures, facial features) of the first show element 20, the second element 22, the guests, and/or other components in the scene. Further, it should be appreciated that the sensors 12 may not be utilized to detect the respective positions of the multiple ride vehicles and/or to trigger the motion profile. For example, in one embodiment, the controller 14 may be configured to receive programmed and/or current timing inputs for the multiple ride vehicles (e.g., speed of travel, spacing, start/stop times), and then to operate the rotatable beam assembly 10 based on the timing inputs to present the motion profile to the respective guests in each of the multiple ride vehicles. In one embodiment, the controller 14 may control the multiple ride vehicles and the rotatable beam assembly 10 in a coordinated manner to present the motion profile to the respective guests in each of the multiple ride vehicles.

As noted here, the first show element 20 and the second show element 22 may be communicatively coupled to the controller 14. The first show element 20 and the second show element 22 may have controllable features, such as servo motor(s) and/or actuator(s) that drive movement of one portion relative to another portion (e.g., drive wings to move relative to a body), light emitters that emit light, and/or speakers that emit sound. Thus, the controller 14 may provide control signals to control the controllable features of the first show element 20 and the second show element 22 as the first show element 20 and the second show element 22 travel through the scene (e.g., travel along the rotatable beam 28). Further, the controller 14 may control other components in the scene, such as light emitters and/or speakers mounted on walls, to coordinate output of light and sounds as the motion profile is presented to the respective guests in each of the multiple ride vehicles.

The controller 14 may include the processor 16 and the memory device 18. The processor 16 may include one or more processors and may provide control signals to certain controllable components (e.g., the one or more motors 24, 26; the show elements; and/or the ride vehicles). The processor 16 may receive inputs, such as inputs from the sensors 12, and then provide the control signals to the controllable components in response to the inputs. The memory device 18 may include one or more tangible, non-transitory, computer-readable media that store instructions executable by the processor 16. The time period, the motion profile, or the like may be stored in the memory device 18 so that the preferred operations related to presentation of a storyline in the scene may be performed automatically via the processor 16 with or without supervision by an operator (e.g., human operator). The memory device 18 may include random access memory (RAM), read only memory (ROM), rewritable non-volatile memory such as flash memory, hard drives, optical discs, and/or the like. Additionally, the processor 16 may include one or more general purpose microprocessors, one or more application specific processors (ASICs), one or more field programmable gate arrays (FPGAs), or any combination thereof. The controller 14 may also include components for operator interaction with the amusement park ride system 8, such as via display panels and/or input/output devices (e.g., checking operating parameters, inputting desired operating parameters, checking error logs and historical operations).

Figure 2:
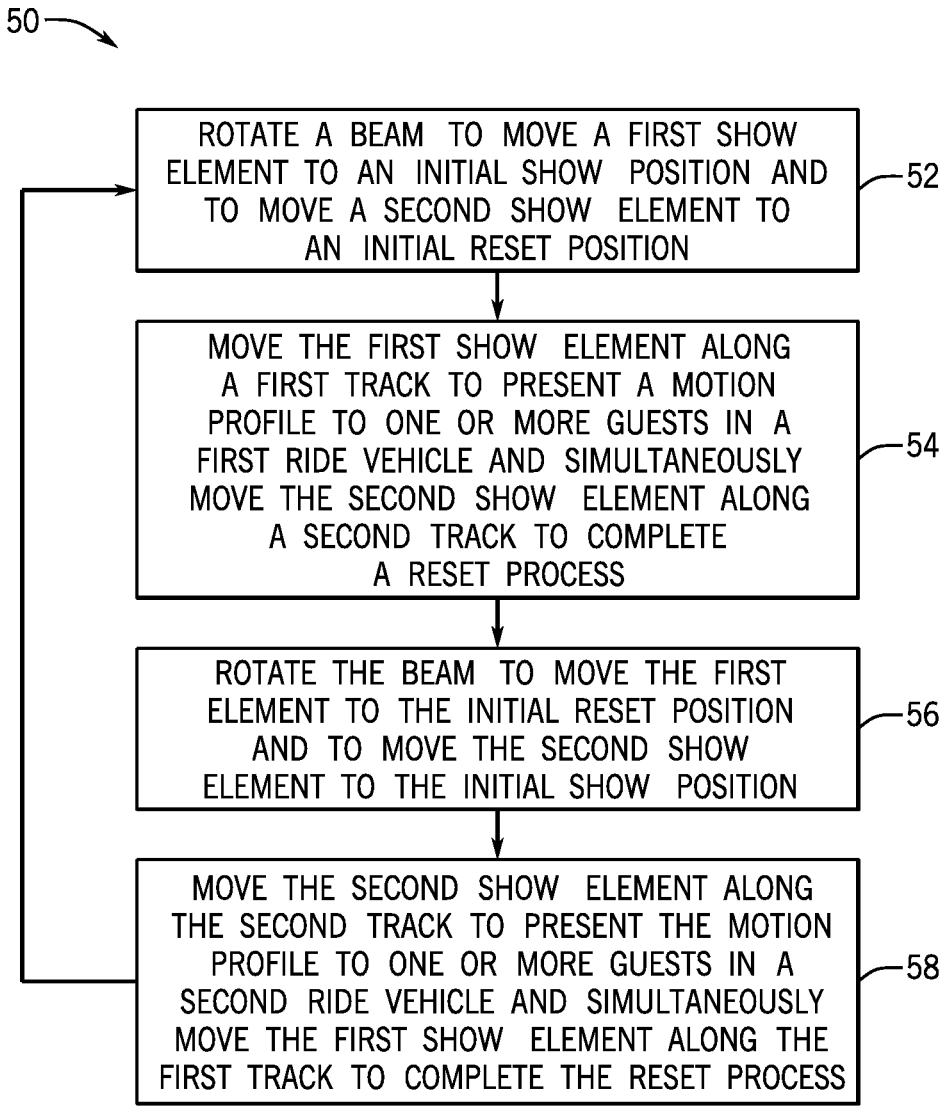
FIG. 2 is a flow chart of a process for deploying and resetting show elements of the amusement park ride system of FIG. 1, in accordance with an embodiment of the present disclosure.

FIG. 2. is a flow diagram of a process 50 for deploying and resetting show elements 20, 22 of the amusement ride system of 8 of FIG. 1. Any suitable device, such as the processor 16, may perform the process 50. In some embodiments, the process 50 may be implemented by executing instructions stored in a non-transitory, computer-readable medium, such as the memory device 18, using the processor 16. While the process 50 is described using blocks in a specific sequence, it should be understood that the present disclosure contemplates that the blocks may be performed in a different order, certain blocks may be omitted, and/or additional blocks may be added.

At block 52, the processor 16 provides control signals to the one or more motors 24 to rotate the rotatable beam 28 to move the first show element 20 to an initial show location and to move the second show element 22 to an initial reset location. As discussed herein, the first show element 20 may be coupled (e.g., slidingly coupled) to a first track disposed on a first side of the rotatable beam 28 to enable the first show element 20 to translate (e.g., slide) along the first track, and the second show element 22 may be coupled (e.g., slidingly coupled) to a second track disposed on a second side of the rotatable beam 28 (e.g., the second side of the rotatable beam 28 may be opposite the first side of the rotatable beam 28) to enable the second show element 22 to translate (e.g., slide) along the second track. Thus, rotation of the rotatable beam 28 moves both the first show element 20 and the second show element 22. It should be noted that the initial show location for the first show element 20 or the second show element 22 is essentially a respective starting position for a viewable presentation of the respective element 20, 22 along a respective first track or second track. The first show element 20 or the second show element 22 may be rotated into the initial show location from a concluding reset location as the rotatable beam 28 is rotated. That is, after the respective show element 20, 22 has completed its reset transition (e.g., traversed the respective track positioned on a back side of the rotatable beam 28), it can be rotated into the initial show location before proceeding to traverse the respective track (e.g., the track positioned on the front side of the beam) for viewing by the guests.

At block 54, the processor 16 provides control signals (e.g., a command or instruction) to move the first show element 20 along the first track to present a motion profile to one or more guests in a first ride vehicle 30. For example, the first show element 20 may be in the initial show location (with the rotatable beam 28 rotated such that the motion profile will be viewable by guests), then move along the first track toward the first ride vehicle 30 to present the motion profile to the one or more guests in the first ride vehicle 30, and then proceed to a concluding show location on the first track. In conjunction with providing the control signals to move the first show element 20 from its initial show location to its concluding show location, the processor 16 may provide control signals to move (e.g., simultaneously) the second show element 22 from an initial reset location on the second track to a concluding reset location on the second track, which is positioned out of view with the current rotational positioning of the rotatable beam 28. In this way, the first show element 20 may present the motion profile as the second show element 22 completes a reset process.

At block 56, the processor 16 provides control signals to the one or more motors 24 to rotate the rotatable beam 28 such that the second track is positioned for viewing and the first track is hidden from viewing by the guests. This results in moving the first show element 20 to the initial reset location (from the concluding show location) and moving the second show element 22 to the initial show location (from the concluding reset location). At block 58, the processor 16 provides control signals to move the second show element 22 along a second track to present the motion profile to one or more guests in a second ride vehicle 32. For example, the second show element 22 may be in the initial show location (with the rotatable beam 28 rotated such that the motion profile will be viewable by guests), then move along the second track toward the second ride vehicle 32 to present the motion profile to the one or more guests in the second ride vehicle 32. As discussed herein, the rotation of the rotatable beam 28 and/or the movement of the show elements 20, 22 relative to the rotatable beam 28 may be coordinated with travel of the multiple ride vehicles so that the respective guests in each of the multiple ride vehicles is presented with the motion profile (e.g., a complete motion profile, from beginning to end) as they travel through the scene.

Figure 3:
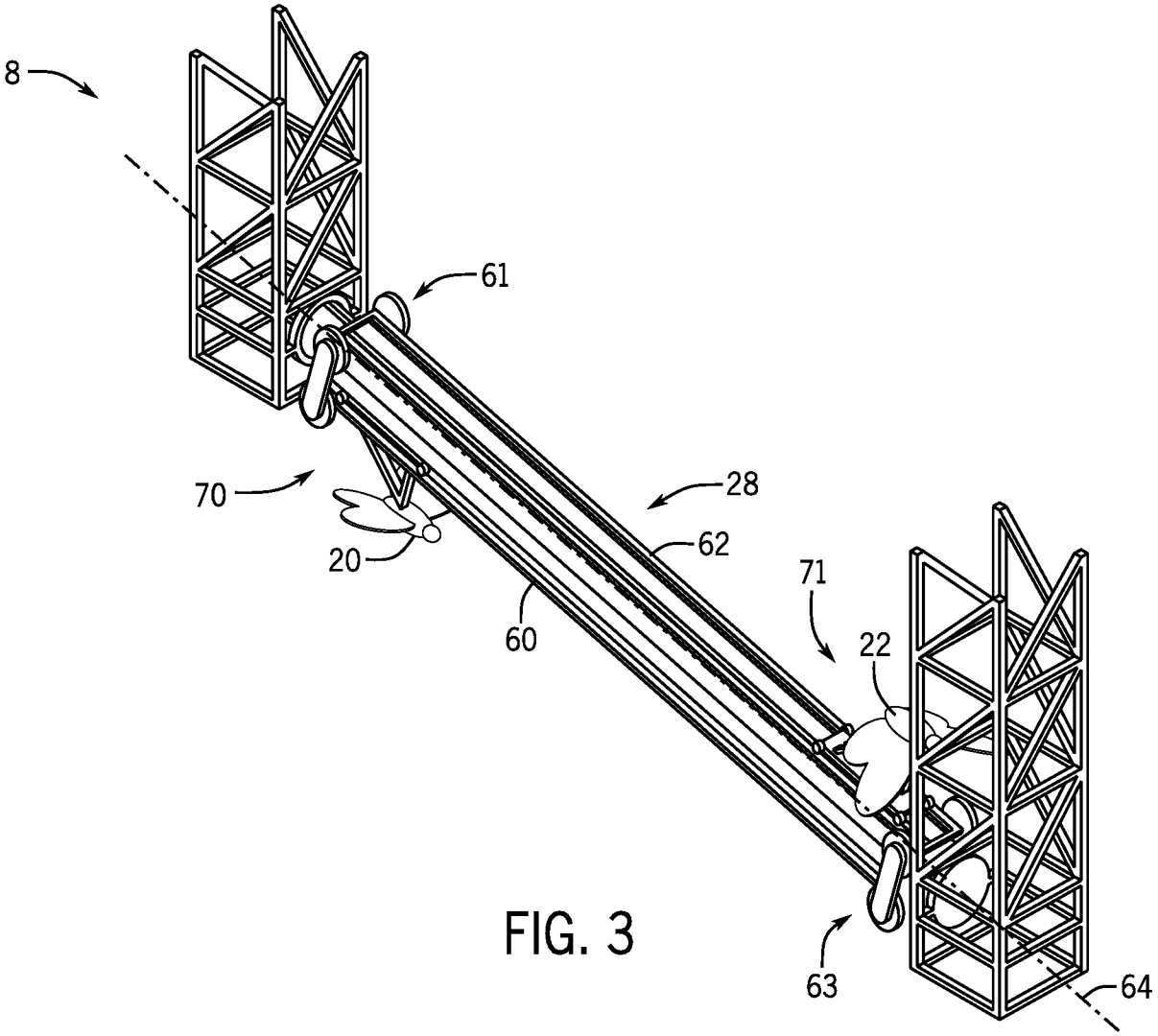
FIG. 3 is a perspective view of a portion of the amusement park ride system of FIG. 1, wherein a first show element is in an initial show location and a second show element is in an initial reset location, in accordance with an embodiment of the present disclosure.

FIGS. 3-7 illustrate an embodiment of a portion of the amusement park ride system 8 of FIG. 1 at different times in the process 50 of FIG. 2. In particular, FIG. 3 is a perspective view of a portion of the amusement park ride system 8, wherein the first show element 20 is in an initial show location 70. When the first show element 20 is in the initial show location 70, the first show element 20 may be at a first end (e.g., end portion) of a first track 60 that is coupled to the rotatable beam 28. Additionally, when the first show element 20 is in the initial show location 70, the second show element 22 is in an initial reset location 71. When the second show element 22 is in the initial reset location 71, the second show element 22 may be at a second end (e.g., end portion) of a second track 62 that is coupled to the rotatable beam 28. As shown, the first track 60 is on a first side of the rotatable beam 28, and the second track 62 is on a second side of the rotatable beam 28 that is opposite the first side of the rotatable beam 28. The first end of the first track 60 is proximate to a first end 61 (e.g., end portion) of the rotatable beam 28, and the second end of the second track 62 is proximate to a second end 63 (e.g., end portion) of the rotatable beam 28. Similarly, a first end (e.g., end portion) of the second track 62 is proximate to the first end 61 of the rotatable beam 28, and a second end (e.g., end portion) of the first track 60 is proximate to the second end 63 of the rotatable beam 28. As shown, the rotatable beam 28 is configured to rotate about its axis of rotation 64.

Figure 4:
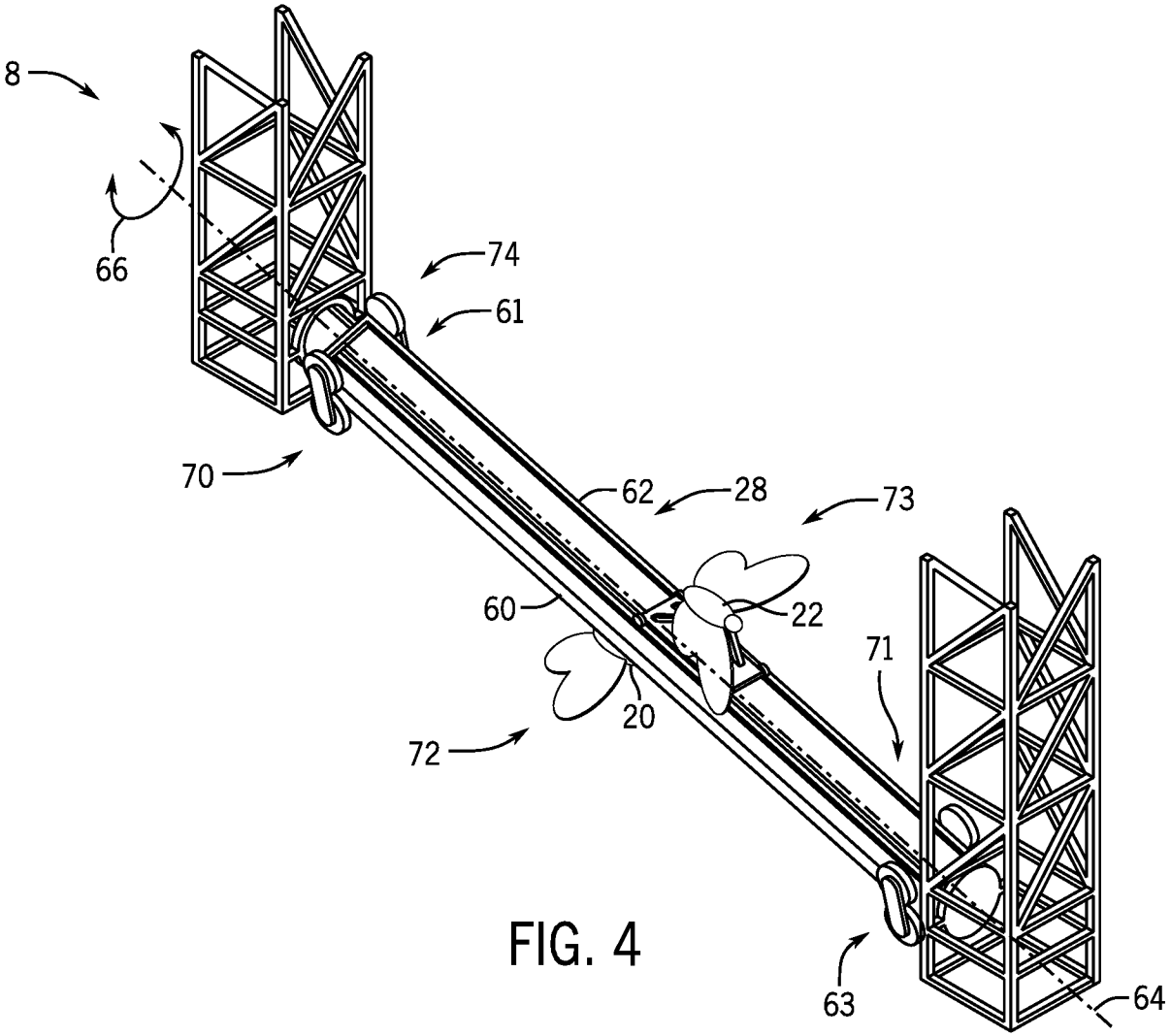
FIG. 4 is perspective view of a portion of the amusement park ride system of FIG. 1, wherein the first show element is translating in a show location as part of a motion profile, and simultaneously the second show element is translating in a reset location as part of a reset process, in accordance with an embodiment of the present disclosure.

FIG. 4 is perspective view of a portion of the amusement park ride system 8, wherein the first show element 20 is in a show location 72 (e.g., a show side, location, or area) and translates along the first track 60 to perform the motion profile, which may be part of a storyline presented in the scene. As the first show element 20 is in the show location 72 and translates along the first track 60 (e.g., traverses the first track 60 in a first direction; toward the second end 63 of the rotatable beam 28) to perform the motion profile, the second show element 22 is in a reset location 73 (e.g., a reset side, location, or area) and translates along the second track 62 (e.g., traverses the second track 62 in a second direction, opposite the first direction; toward the first end 61 of the rotatable beam 28) to carry out a reset process. The reset process generally transports the second show element 22 toward a concluding reset location 74 (also toward the initial show location 70) and prepares the second show element 22 to perform the motion profile at a later time (e.g., for the next ride vehicle; after the first show element 20 completes the motion profile). As the first show element 20 translates along the first track 60 to perform the motion profile and the second show element 22 translates along the second track 62 to carry out the reset process, the first show element 20 and the second show element 22 may pass under/over one another. In one embodiment, the rotatable beam 28 may enhance movement effects by rotating back and forth along its axis of rotation 64 (e.g., about 10 to 90, 20 to 60, or 30 to 45 degrees, side to side, first and second rotational directions) as shown by arrows 66 such that the first show element 20 sways back and forth as it translates along the first track 60 (the second show element 22 also sways, but may not be visible to the guests).

Figure 5:
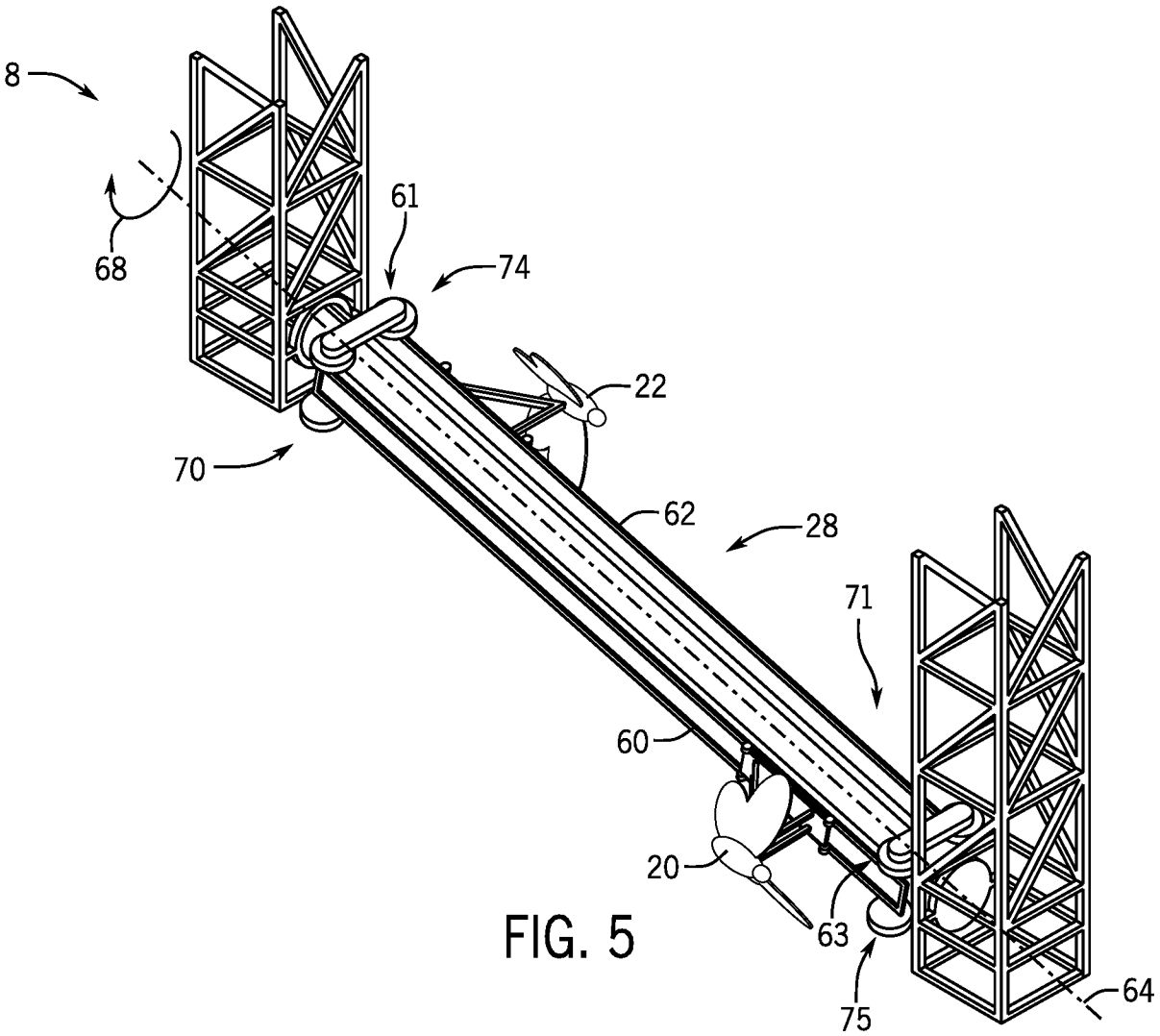
FIG. 5 is a perspective view of a portion of the amusement park ride system of FIG. 1, wherein the first show element is being rotated from the show location to the reset location via a rotation of a rotatable beam, and simultaneously the second show element is being rotated from the reset location to the show location via the rotation of the rotatable beam, in accordance with an embodiment of the present disclosure.

FIG. 5 is a perspective view of a portion of the amusement park ride system 8 during rotation of the rotatable beam 28. The rotation of the rotatable beam 28 in a first rotational direction, represented by arrow 68, about the axis of rotation 64 causes rotation of the first show element 20 and the first track 60 in the first rotational direction about the axis of rotation 64. At the same time (e.g., simultaneously), the rotation of the rotatable beam 28 in the first rotational direction about the axis of rotation 64 causes rotation of the second show element 22 and the second track 62 in the first rotational direction about the axis of rotation 64. In one embodiment, the rotation of the rotatable beam 28 (e.g., the rotation that moves the first show element 20 from a concluding show location 75 to the initial reset location 71 and the second show element 22 from the concluding reset location 74 to the initial show location 70) may be carried out after the first show element 20 completes the motion profile, after the second show element 22 completes the reset process, after the first show element 20 reaches the second end of the first track 60 (which is proximate the second end 63 of the rotatable beam 28), after the second show element 22 reaches the first end of the second track 62 (which is proximate the first end 61 of the rotatable beam 28), after the first show element 20 stops its sliding movement along the first track 60, and/or after the second show element 22 stops its translating movement along the second track 62. In one embodiment, at least a portion of the rotation of the rotatable beam 28 (e.g., the rotation that moves the first show element 20 from the concluding show location 75 to the initial reset location 71 and the second show element 22 from the concluding reset location 74 to the initial show location 70) may be carried out as the first show element 20 translates along the first track 60 and/or as the second show element 22 translates along the second track 62.

Figure 6:
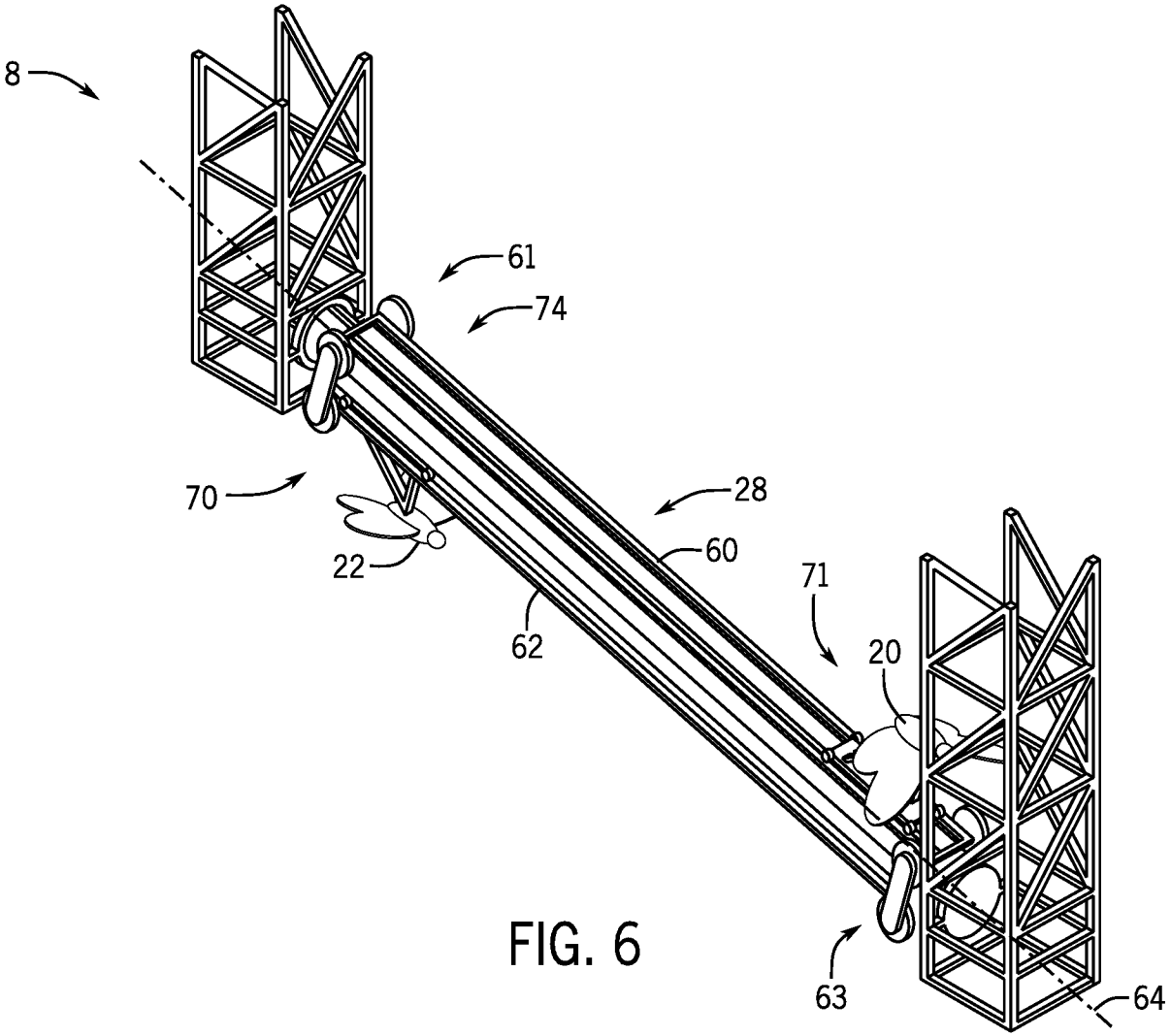
FIG. 6 is a perspective view of a portion of the amusement park ride system of FIG. 1, wherein the second show element is in the initial show location and the first show element is in the initial reset location, in accordance with an embodiment of the present disclosure.

FIG. 6 is a perspective view of a portion of the amusement park ride system 8, wherein the second show element 22 is in the initial show location 70. When the second show element 22 is in the initial show location 70, the second show element 22 may be at the first end of the second track 62 (which is proximate the first end 61 of the rotatable beam 28). Additionally, when the second show element 22 is in the initial show location 70, the first show element 20 is in the initial reset location 71. When the first show element 20 is in the initial reset location 71, the first show element 20 may be at the second end of the first track 60 (which is proximate the second end 63 of the rotatable beam 28). To move from FIG. 5 to FIG. 6, the rotatable beam 28 may rotate about the axis of rotation 64 (e.g., approximately 45 to 180 degrees, approximately 60 to 120 degrees, approximately 90 to 180 degrees, approximately 90 degrees, or approximately 180 degrees about the axis of rotation 64).

Figure 7:
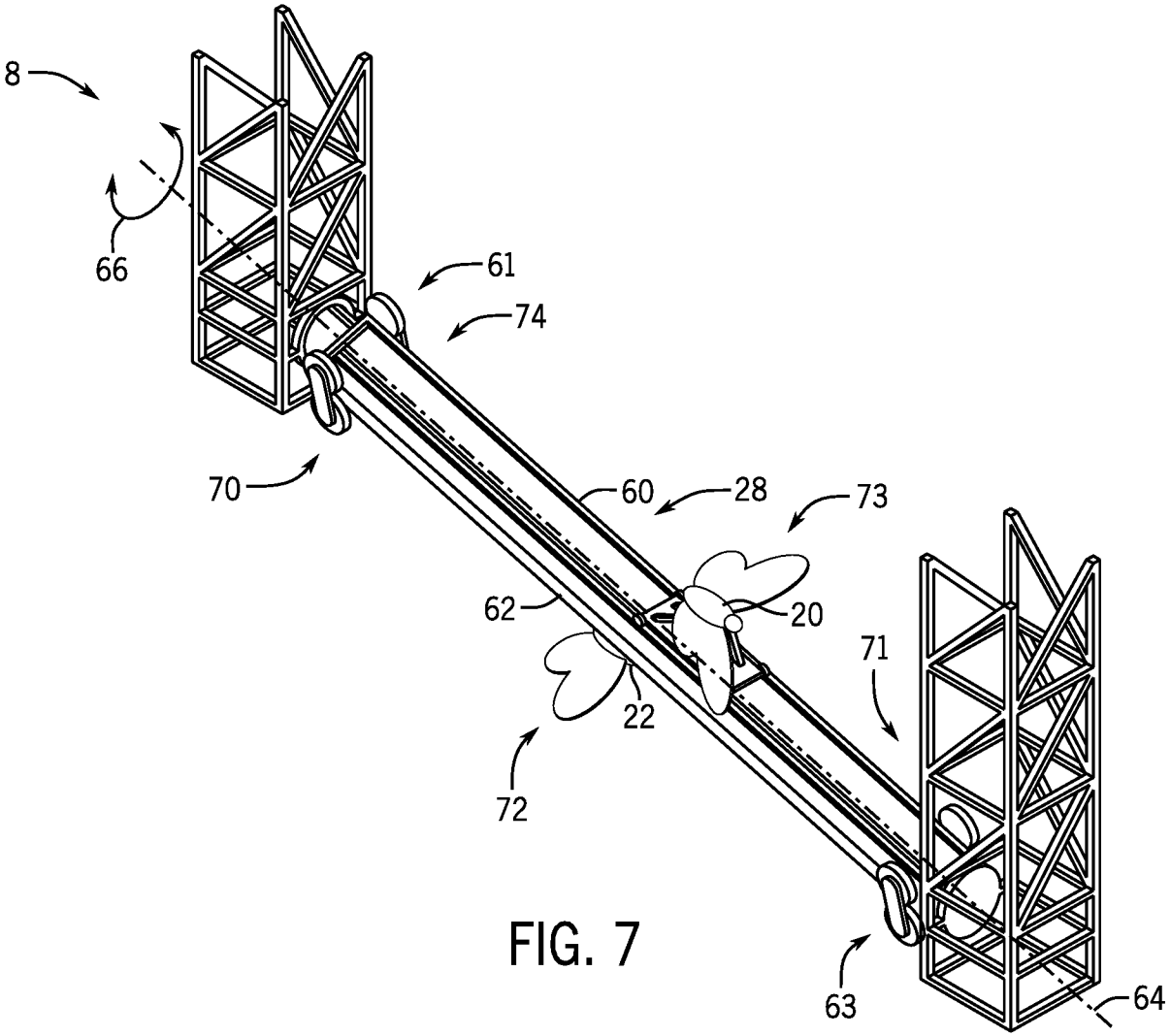
FIG. 7 is a perspective view of a portion of the amusement park ride system of FIG. 1, wherein the second show element is translating in the show location as part of the motion profile, and simultaneously the first show element is translating in the reset location as part of the reset process, in accordance with an embodiment of the present disclosure.

FIG. 7 is a perspective view of a portion of the amusement park ride system 8, wherein the second show element 22 is in the show location 72 and translates along the second track 62 to perform the motion profile, which may be part of the storyline presented in the scene. As the second show element 22 is in the show location 72 and translates along the second track 62 (e.g., traverses the second track 62 in the first direction; toward the second end 63 of the rotatable beam 28) to perform the motion profile, the first show element 20 is in the reset location 73 and translates along the first track 60 (e.g., traverses the first track 60 in the second direction, opposite the first direction; toward the first end 61 of the rotatable beam 28) to carry out the reset process that transports the first show element 20 to the concluding reset location 74 (and also toward the initial show location 70). The reset process also prepares the first show element to perform the motion profile at a later time (e.g., for the next ride vehicle; after the second show element 22 completes the motion profile). As the second show element 22 translates along the second track 62 to perform the motion profile and the first show element 20 translates along the first track 60 to carry out the reset process, the second show element 22 and the first show element 20 may pass under/over one another. In one embodiment, the rotatable beam 28 may add to motion effects by rotating back and forth along its axis of rotation 64 such that the second show element 20 sways back and forth as shown by arrows 66 as it translates along the second track 62 (the first show element 22 also sways, but may not be visible to the guests).

As shown in FIGS. 3-7, the show elements 20, 22 may be slidingly coupled to the tracks 60, 62 via respective sliding platforms (e.g., rolling bogies or brackets) that translate along the tracks 60, 62. The respective sliding platforms may be considered to be part of the rotatable beam assembly 10, and the show elements 20, 22 may be removably coupled to connection points on the respective sliding platforms. For example, the first show element 20 may be connected to a first sliding platform (e.g., via a fastener, such as a hook or a clip), and the first sliding platform may carry the first show element 20 along the first track 60 as described herein. Similarly, the second show element 22 may be connected to a second sliding platform (e.g., via a fastener, such as a hook or a clip), and the second sliding platform may carry the second show element 20 along the second track 62 as described herein. This configuration may enable the show elements 20, 22 to be efficiently exchanged with other show elements, such as to change the storyline and/or for maintenance operations (e.g., to repair components of the show elements 20, 22). It should also be appreciated that the rotatable beam 28 disclosed herein may have any suitable form (e.g., a linear beam, a curved beam, or any beam with linear and curved portions; any cross-sectional shape, such as an I-shape, a circular shape, a rectangular shape, a truss section, or any combination thereof). Further, the rotatable beam assembly 10 may include other forms and/or components that enable the show elements 20, 22 to traverse the rotatable beam 28 in the manner disclosed herein (e.g., in opposite directions). For example, the rotatable beam assembly 10 may include pulley systems (e.g., cables and pulleys) that drive movement of the show elements 20, 22, bogie systems (e.g., bogies that travel along the tracks 60, 62) that drive movement of the show elements 20, 22, or the like.

It should be appreciated that the rotatable beam assembly 10 and the show elements 20, 22 may be positioned to present one of the show elements 20, 22 to the respective guests of each of the multiple ride vehicles that travel along the path 36. For example, the rotatable beam assembly 10 with the show elements 20, 22 may be suspended from a ceiling or supported on another surface (e.g., a floor or a wall) within the scene. In this way, the respective guests of the first ride vehicle 30 may view the first show element 20 as it performs the motion profile, then the respective guests of the second ride vehicle 32 may view the second show element 22 as it performs the motion profile, then the respective guests of the third ride vehicle 34 may view the first show element 20 as it performs the motion profile, and so on. Thus, the one show element that is in the show location is visible to the respective guests in the ride vehicle(s) at the scene, while the other show element that is in the reset location is not visible to the respective guests in the ride vehicle(s) at the scene (or possibly not visible to any ride vehicle in the amusement park ride system 8). For example, the other show element that is in the reset location may be hidden from view by the ceiling or other structure. It should be appreciated that the other show element that is in the reset location may be visible to the respective guests in the ride vehicle(s) in the scene or in another scene, or visible to other guests (who may be in ride vehicle(s)) in another scene. For example, the other show element may be visible to other guests being carried by other ride vehicle(s) through another scene of the attraction. It should be appreciated that the show elements 20, 22 may be visible during an entirety of their travel along their respective tracks 60, 62 or only during some of their travel along their respective tracks 60, 62. For example, the show elements 20, 22 may be visible in the initial show location or may not be visible in the initial show location. As another example, the show elements 20, 22 may be visible as they begin to rotate into the initial reset location or may not be visible as they begin to rotate into the initial reset location.

As discussed herein, each show element 20, 22 (e.g., mechanical butterfly) may include one or more actuators to drive movement of portions (e.g., mechanical wings) of the show element 20, 22 to enhance the experience of the guests. For example, sliding the mechanical butterfly along the track may make it appear as if a butterfly is flying toward the guests. In one embodiment, the show elements 20, 22 may include any of a variety of morphing mechanisms that allow a shape (e.g., geometric configuration) of the show elements 20, 22 to change over time. For example, the one or more actuators (e.g., servo motor or a pneumatic actuator, or both) may maneuver structural features of the first show element 20 to cause the first show element to change geometric configurations. The first show element 20 and the second show element 22 may include the same or different types of show elements having similar or different structures for changing one or more geometric characteristics of particular set pieces. For example, the first show element 20 and the second show element 22 coupled to the rotatable beam 28 may be soft robots. In some embodiments, the first show element 20 and the second show element 22 include fixed geometry show elements or modifiable geometry show elements. Thus, the first show element 20 and the second show element 22 may be duplicates of one another and/or may perform the same motion profiles and/or the same shape changes to provide the same experiences and storylines (e.g., the same may refer to essentially the same; designed to be perceived to be essentially the same by guests). It should also be appreciated that the first show element 20 and the second show element 22 may be different and/or may perform different motion profiles and/or different shape changes to provide varied experiences and storylines.

While some embodiments may include only a single beam 28, one or more additional beams with one or more additional show elements may be installed in the amusement park ride system 8. The one or more additional beams may be located at a different depth (e.g., further in the background) than the rotatable beam 28 relative to the ride vehicles. By utilizing multiple beams in this manner, present embodiments may provide additional effects to provide immersion in a scene. For example, the one or more additional show elements may include miniature structures that represent background features (e.g., trees) and the one or more additional beams may move the one or more additional show elements slower relative to the show elements 20, 22 to create an illusion of depth and realistic movement.

While only certain features of the disclosure have been illustrated and described herein, many modifications and changes will occur to those skilled in the art. It is, therefore, to be understood that the appended claims are intended to cover all such modifications and changes as fall within the true spirit of the present disclosure. The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . "or" step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A show system, comprising a rotatable beam assembly comprising a rotatable beam, a first track, a second track, and one or more motors;

a first show element coupled to the first track to enable the first show element to translate along the first track and a second show element coupled to the second track to enable the second show element to translate along the second track; and a controller communicatively coupled to the rotatable beam assembly and configured to provide control signals to the one or more motors to:

with the first show element in a show location, drive the first show element to translate along the first track to present a respective motion profile in a scene;

rotate the rotatable beam to cause the first show element to rotate from the show location to a reset location and to cause the second show element to rotate from the reset location to the show location; and with the second show element in the show location, drive the second show element to translate along the second track to present a respective motion profile in the scene.

2. The show system of claim 1, wherein the controller is configured to provide the control signals to the one or more motors to drive the first show element to translate along the first track in a first direction to present the respective motion profile in the scene, and simultaneously drive the second show element to translate along the second track in a second direction to carry out a reset process.

3. The show system of claim 1, wherein the first track is disposed on a first side of the rotatable beam and the second track is disposed on a second side of the rotatable beam.

4. The show system of claim 3, wherein the first side is opposite the second side.

5. The show system of claim 1, wherein the first show element is a duplicate of the second show element.

6. The show system of claim 1, wherein the respective motion profile presented by the first show element is a duplicate of the respective motion profile presented by the second show element.

7. The show system of claim 1, wherein the first show element, the second show element, or both are configured to morph between one or more geometric configurations.

8. The show system of claim 1, comprising an actuator configured to move one portion of the first show element relative to another portion of the first show element as the first show element translates along the first track to present the respective motion profile.

9. The show system of claim 1, wherein controller is configured to provide the control signals to the one or more motors to drive the first show element to translate along the first track to present the respective motion profile to one or more guests in a first ride vehicle and to drive the second show element to translate along the second track to present the respective motion profile to one or more additional guests in a second ride vehicle.

10. The show system of claim 9, comprising one or more sensors configured to generate signals indicative of a position of the first ride vehicle, wherein the controller is communicatively coupled to the one or more sensors and is configured to provide the control signals to the one or more motors to drive the first show element to translate along the first track to present the respective motion profile based on the position of the first ride vehicle.

11. A method of operating a show system, the method comprising:

driving, via one or more motors and with a first show element in a show location, the first show element to translate in a first direction along a first track coupled to a rotatable beam to present a respective motion profile to one or more guests in a first ride vehicle;

rotating, via the one or more motors, the rotatable beam to cause the first show element to rotate from the show location to a reset location and to cause a second show element to rotate from the reset location to the show location; and driving, via the one or more motors and with the second show element in the show location, the second show element to translate in the first direction along a second track to present a respective motion profile to one or more additional guests in a second ride vehicle.

12. The method of claim 11, wherein rotating the rotatable beam causes the first show element to rotate from the show location to the reset location, and simultaneously causes the second show element to rotate from the reset location to the show location.

13. The method of claim 11, comprising driving the first show element to translate in the first direction along the first track, and simultaneously driving, via the one or more motors, the second show element to translate along the second track in a second direction to carry out a reset process.

14. The method of claim 11, wherein rotating the rotatable beam comprises rotating the rotatable beam approximately 90 to 180 degrees.

15. The method of claim 11, comprising driving, via an actuator of the first show element, one portion of the first show element relative to another portion of the first show element as the first show element translates in the first direction along the first track to present the respective motion profile.

16. The method of claim 11, comprising rotating, via the one or more motors, the rotatable beam back and forth to cause the first show element to sway as the first show element translates in the first direction along the first track coupled to the rotatable beam to present the respective motion profile to the one or more guests in the first ride vehicle.

17. The method of claim 11, comprising:

receiving, at a controller, signals indicative of a position of the first ride vehicle; and driving the first show element to translate in the first direction along the first track coupled to the rotatable beam to present the respective motion profile to the one or more guests in the first ride vehicle based on the position of the first ride vehicle.

18. A show system, comprising:

a rotatable beam assembly comprising a rotatable beam, a first track positioned on a first side of the rotatable beam, a second track positioned on a second side of the rotatable beam, and one or more motors configured to drive rotation of the rotatable beam;

a first show element coupled to the first track to enable the first show element to translate along the first track;

a second show element coupled to the second track to enable the second show element to translate along the second track; and a controller configured to provide control signals to one or more motors to rotate the rotatable beam to alternate presentation of the first show element and the second show element within a scene.

19. The show system of claim 18, wherein the first side of the rotatable beam is opposite the second side of the rotatable beam.

20. The show system of claim 18, wherein the controller is configured to provide the control signals to the one or more motors to rotate the rotatable beam to:

present the first show element in the scene to enable the first show element to provide a respective motion profile for viewing by a guest while the second show element is in a reset location; and present the second show element in the scene to enable the second show element to provide a respective motion profile for viewing by another guest while the second show element is in the reset location.

* * * * *